United States Patent [19]

Watanabe

[11] Patent Number: 5,073,799

[45] Date of Patent: Dec. 17, 1991

[54] IMAGE FORMING APPARATUS WHICH ALTERS STAND-BY TEMPERATURE OF THE FIXING DEVICE ACCORDING TO TONER COLOR

[75] Inventor: Tsuyoshi Watanabe, Kawasaki, Japan

[73] Assignee: Canon Kabushiki Kaisha, Tokyo, Japan

[21] Appl. No.: 401,108

[22] Filed: Aug. 31, 1989

[30] Foreign Application Priority Data

Sep. 2, 1988 [JP] Japan ..... 63-218276

[51] Int. Cl.[5] ..... G03G 15/20

[52] U.S. Cl. ..... 355/285; 355/208; 219/216

[58] Field of Search ..... 355/295, 290, 285, 282, 355/208, 245, 326, 327, 206, 311; 219/216, 469; 432/60, 228

[56] References Cited

U.S. PATENT DOCUMENTS

| | | | |
|---|---|---|---|
| 4,097,139 | 6/1978 | Hauser et al. | 355/326 |
| 4,144,835 | 3/1979 | Fukase et al. | 219/216 X |
| 4,385,826 | 5/1983 | Itoh | 355/295 |
| 4,480,908 | 11/1984 | Anzai et al. | 355/285 |
| 4,696,880 | 9/1987 | Shoji et al. | 430/42 |

FOREIGN PATENT DOCUMENTS

| | | | |
|---|---|---|---|
| 0070571 | 4/1986 | Japan | 355/208 |
| 61-103178 | 5/1986 | Japan . | |
| 0126585 | 6/1986 | Japan | 355/208 |
| 0204651 | 9/1986 | Japan | 355/245 |
| 0200382 | 9/1987 | Japan | 355/208 |

OTHER PUBLICATIONS

European Search Report.

*Primary Examiner*—Arthur T. Grimley
*Assistant Examiner*—William J. Royer
*Attorney, Agent, or Firm*—Fitzpatrick, Cella, Harper & Scinto

[57] ABSTRACT

An image forming apparatus which can develop a latent image formed on a latent image bearing member with a selected one of a first toner and a second toner different from the first toner. A fixing member is provided for fixing a toner image, and includes a heat member heated by a heat source being contacted with the toner image. A controller is provided for adjusting a temperature difference between a stand-by temperature and the fixing temperature in accordance with the selected toner.

8 Claims, 4 Drawing Sheets

IMAGE FORMING APPARATUS WHICH ALTERS STAND-BY TEMPERATURE OF THE FIXING DEVICE ACCORDING TO TONER COLOR

BACKGROUND OF THE INVENTION

1. Field of the Invention

The present invention relates to an image forming apparatus such as an electrophotographic apparatus, electrostatic recording apparatus and the like, and more particularly, it relates to an image forming apparatus which can form an image with different toners and has a fixing device for fixing the image by fusing the toner.

2. Related Background Art

In a conventional image forming apparatus such as an electrophotographic apparatus, a latent image formed on a latent image bearing member was generally visualized by the use of a single kind of developer (referred to as "toner" hereinafter); however, with the advance of the recent diversity of the image forming techniques and/or colorization of the outputted image, various apparatuses for obtaining a full-color image or plural monocolor images have been proposed and applied in practical use. The image forming process in these apparatuses is fundamentally the same as that of the image forming apparatus utilizing a single toner. However, in these apparatuses, since a plurality of toners are used, a plurality of developing containers (as developing means) corresponding to the number of toners to be used are incorporated into the apparatus, or are provided for interchanging to obtain a desired color image. Further, normally, a fixing device comprises a rotary member heated by a heat source and a back-up rotary member, whereby the image is fixed by passing a recording medium having the toner image formed thereon through between these rotary members.

However, in the fixing device used with the above-mentioned conventional image forming apparatus, since the same fixing operation is effected with respect to various kinds of toners in spite of the fact that each toner has a different offset generating temperature, in accordance with the toner component such as resin, magnetic component of the like, there arises a problem that the toner is adhered to the fixing rollers to finally generate the offset phenomenon. For example, when both the magnetic toner including the magnetic component and the non-magnetic toner not including the magnetic component for obtaining the sharp colored image are used, since the non-magnetic toner has a lower offset generating temperature than that of the magnetic toner, if the magnetic toner is used as the black toner, the non-magnetic toner generates the offset in the fixing process.

In order to reduce or eliminate the offset toner, as shown in FIGS. 6A to 6C, a positive cleaning means has normally been provided in the fixing device. Incidentally, FIG. 6A shows an example that a cleaning blade is arranged to contact with the fixing roller, FIG. 6B shows an example that a felt oil pad impregnated with the silicone oil is arranged to contact with the surface of the fixing roller, and FIG. 6C shows an example that a web impregnated with the silicone oil is arranged to contact with the surface of the fixing roller.

However, even when the fixing roller is supplied with the silicone oil or is cleaned by the cleaning blade in this way, if the offset of the toner is too severe, a large amount of silicone oil must be applied onto the surface of the fixing roller, with the result that there arises a problem that the recording medium is smeared with the oil and/or the oil pad or web must frequently be exchanged or replaced.

SUMMARY OF THE INVENTION

An object of the present invention is to provide an image forming apparatus which can avoid the generation of the offset of toner in a fixing process even when an image is formed with the different toners.

Another object of the present invention is to provide an image forming apparatus which can alter a stand-by temperature of a fixing device in accordance with the kind of toner to be used.

Other objects of the present invention will be apparent from the following description regarding the present invention.

DESCRIPTION OF THE PREFERRED EMBODIMENTS

Figure 1:
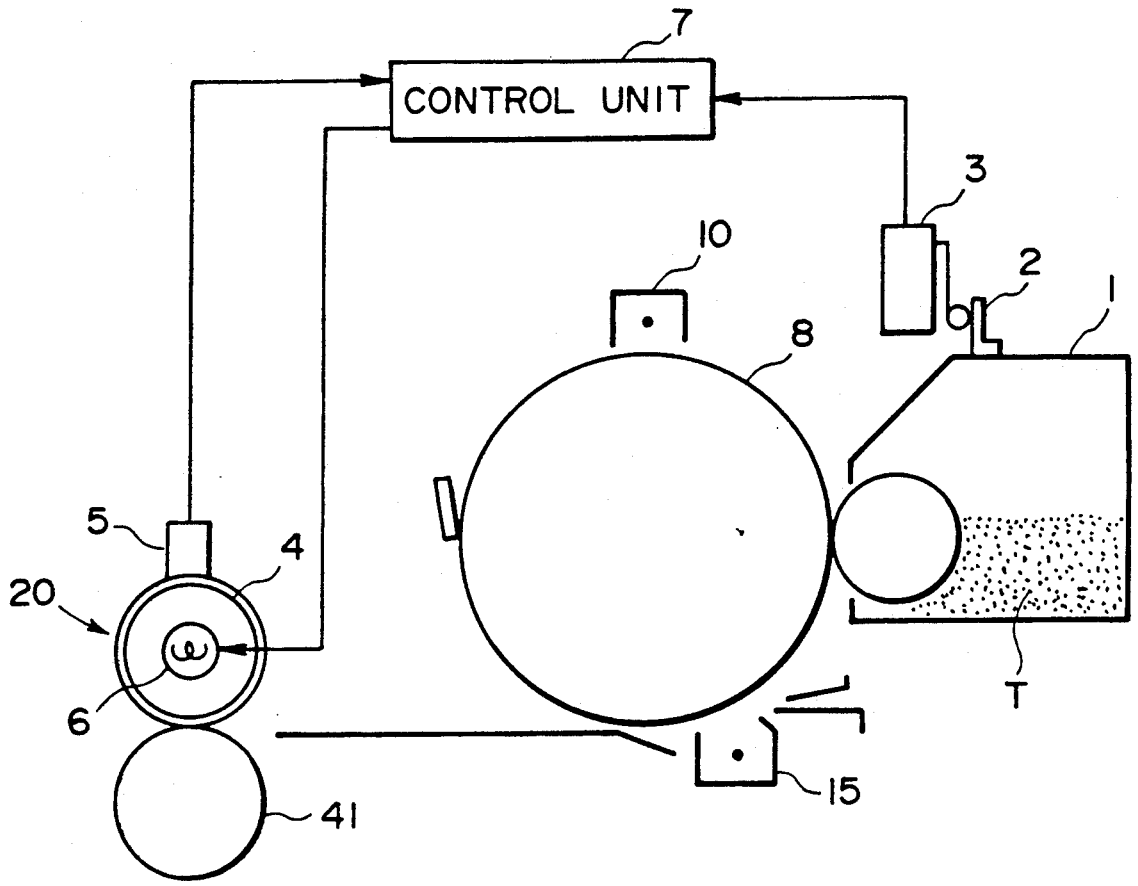
FIG. 1 is a schematic constructural view showing an image forming apparatus according to a preferred embodiment of the present invention.

The present invention will now be explained with reference to the accompanying drawings. Incidentally, elements having the same function will be designated by the same reference numeral.

Referring to FIG. 1, an electrophotographic image forming apparatus according to a preferred embodiment of the present invention is schematically shown. In FIG. 1, the image forming apparatus comprises a developing container 1 as a developing means, a control unit 7 as a control means, a photosensitive sensitive drum 8 as a latent image bearing member, a charger 10, a transfer charger 15, and a fixing device 20 as a thermal fixing means.

In the image forming apparatus, the developing container 1 accommodates toner T as developer and visualizes a latent image formed on the photosensitive drum 8 with the toner. In the illustrated embodiment, the developing container is designed that it is removable with respect to the image forming apparatus. Further, a lever 2 as a discriminating means is fixed to the developing container 1 for pushing one of switches 3 as discriminating signal generating means (described later). The lever is situated in a different position for each of the developing containers accommodating different toners T.

Each of the switches 3 is a so-called microswitch having a microgap and a snapping action mechanism, and is connected to the control unit 7. The number of the switches 3 is the same as the number of toners which can be used with the image forming apparatus. When any one of the switches is activated by the lever 2, fixed to the developing container 1 inserted into the apparatus, the switch sends a developer discriminating signal indicative of the closure of the switch to the control unit 7.

The control unit 7 is connected to the switches 3 and the fixing device 20.

The fixing device 20 includes a fixing roller 4 heated by a heater 6, the roller comprises a rotary member contacting with an unfixed toner. A back-up roller 41 pressed against the fixing roller to form a nip therebetween. The unfixed toner image formed on the recording medium is fixed by passing the recording medium through the nip between the fixing roller 4 and the back-up roller 41. A thermistor 5 is provided for detecting a temperature of a surface of the fixing roller 4.

When the control unit 7 receives the signal from any switch 3, it judges or discriminates the kind of toner T on the basis of said signal. After judging the kind of toner, the control unit 7 selects a set temperature conforming to the discriminated toner T, among from various set temperatures previously set in correspondence to the kinds of toner, and supplies a switch closing signal (as a command signal for a closing change-over switch (not shown)) to said change-over switch for switching over the communication and interruption of current to the heater 6 so as to maintain the heater (as a heating element) 6 arranged in the fixing roller 4 at the selected set temperature.

The temperature of the surface of the fixing roller 4 can be detected on the basis of the change in resistance values of the thermistor 5. The control unit 7 reads the resistance value of the thermistor 5, and converts the change in the resistance value of the thermistor 5 into the change in voltage, and further compares the converted voltage with a reference voltage corresponding to the selected set temperature, whereby the control unit 7 controls the heater 6 in such a manner that when the temperature of the thermistor is lower than the set temperature the heater 6 is turned ON and when the temperature of the thermistor becomes higher than the set temperature the heater is turned OFF.

Next, the temperature control for the fixing roller 4 effected by the control unit 7 according to this embodiment will be fully explained with reference to FIGS. 2 to 4.

In the illustrated embodiment, the kinds of toners contained in the removable developing containers are magnetic toner (black toner) $T_1$ and non-magnetic toner (color toner such as red toner, blue toner and the like) $T_2$. When the developing container accommodating the magnetic toner $T_1$ is mounted on the image forming apparatus the control unit 7 selects the set temperature $T_s$ (FIG. 2) in a stand-by condition established after a main switch of the image forming apparatus is turned ON (Main-ON) until a copy start switch is turned ON (Copy-ON), and selects a temperature $T_c$ higher than the set temperature $T_s$ in a fixing process established after the Copy-ON. The reason why an object value for the temperature adjustment during the stand-by condition (referred to as "stand-by temperature" hereinafter) is set lower than an object value for the temperature adjustment during the fixing process (referred to as "fixing temperature" hereinafter) is that a warming up time from the Main-ON to the enabling of the copying operation can be shortened. Incidentally, the "stand-by" condition is not limited to the condition established after the main switch is turned ON until the copy start switch is turned ON, but includes the condition established between the end of the copying operation and the Copy-ON, i.e., the Main-ON condition before the Copy-ON; in other words, the "stand-by" condition means the condition after the main switch is turned ON and that is waiting for a recording command from the control unit to initiate the recording operation.

On the other hand, when the developing container including the non-magnetic toner $T_2$ is mounted on the image forming apparatus, the control unit 7 selects the object value for the stand-by temperature $T_c$ same as the object value for the fixing temperature. The non-magnetic toner $T_2$ is toner not including the magnetic component to obtain a sharp colored image and mainly including resin component. Such non-magnetic toner is used for forming a monocolor image or full color image. Accordingly, the non-magnetic toner $T_2$ has a temperature for generating a so-called high temperature offset, which is lower than an offset generating temperature of the magnetic toner $T_1$. Therefore, although the non-magnetic toner $T_2$ acts effectively at the fixing temperature same as that of the magnetic toner $T_1$, the acceptable temperature range of the non-magnetic toner which does not generate the offset phenomenon is narrower than that of the magnetic toner.

Figure 2:
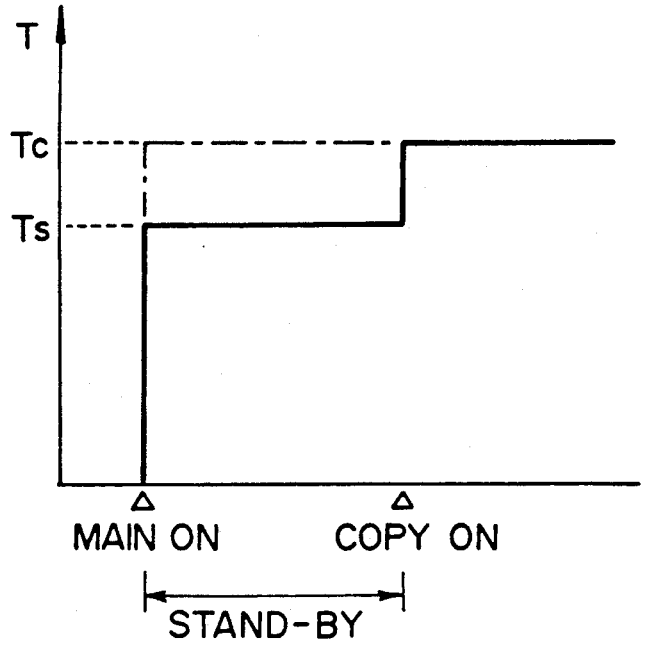
FIG. 2 is a sequence graph for explaining a temperature adjusting level in the apparatus of FIG. 1.
Figure 3:
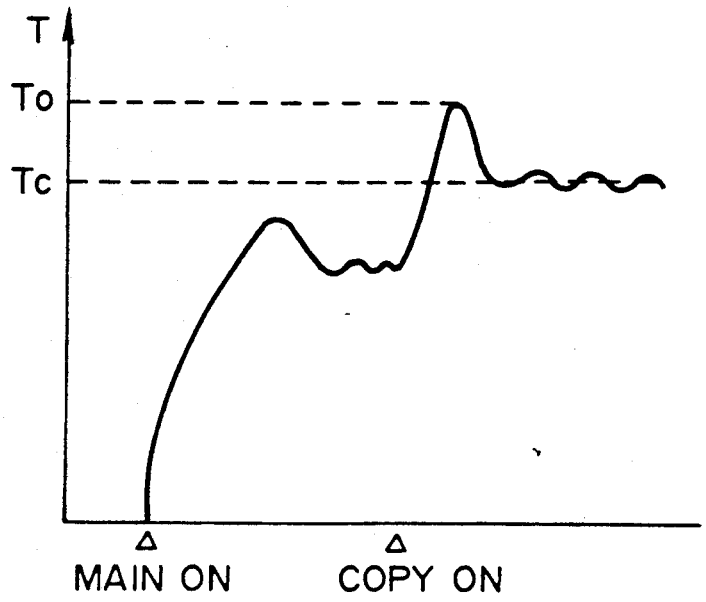
FIG. 3 is a graph showing a temperature condition of a surface of a fixing roller when the temperature adjustment sequence of FIG. 2 is performed.

FIG. 3 shows an actual surface temperature condition of the fixing roller 4 when the temperature adjustment sequence for the stand-by temperature (object value, $T_s$) and the fixing temperature (object value, $T_c$) of the magnetic toner $T_1$ shown in FIG. 2 is performed. As shown in FIG. 3, the temperature adjustment value is changed to the value $T_c$ by the Copy-ON signal, whereby the heater 6 is changed to the ON condition. Even when the surface temperature of the fixing roller 4 reaches the value $T_c$ to thereby change the heater 6 to the OFF condition, since the surface temperature of the fixing roller 4 temporarily increases a value $T_o$ higher than the object value $T_c$ due to the mass of the fixing roller 4 and the like, a so-called overshoot will occur. The temperature $T_o$ becomes higher than the object value $T_c$ by 10° C. or more, thus often generating the high temperature offset of the non-magnetic toner. For this reason, when the toner having a lower offset temperature is used, in the temperature adjustment sequence, the stand-by temperature is set to have a value near the fixing temperature, and preferably, same as the fixing temperature.

Figure 4:
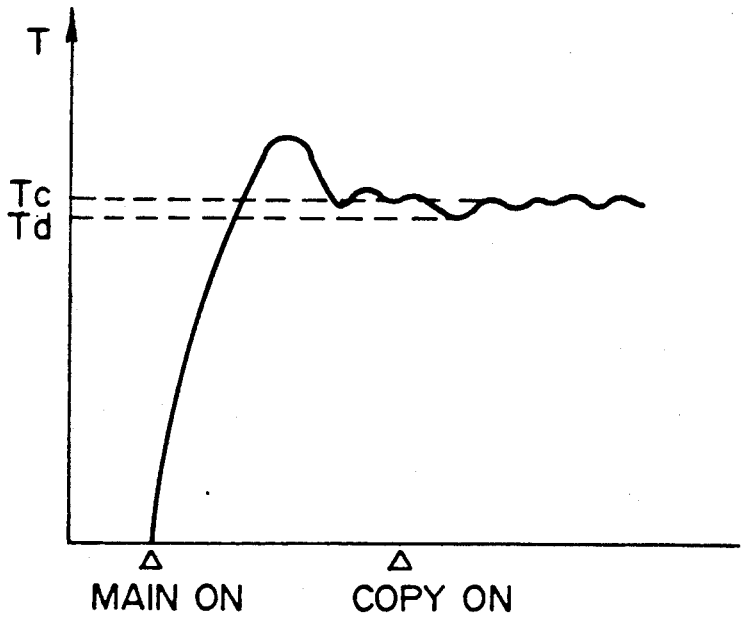
FIG. 4 is a graph showing a temperature condition of the surface of the fixing roller when another temperature adjustment sequence is performed in the apparatus of FIG. 1.

FIG. 4 shows an actual surface temperature of the fixing roller 4 in that case. As apparent from FIG. 4, in this temperature adjustment sequence, since the temperature is maintained at the same value even after the Copy-ON, the over-chute does not occur; to the contrary, the temperature often decreases slightly to a value $T_d$ since the temperature of the fixing roller is absorbed by the recording medium while the latter is passing through the fixing device.

As mentioned above, in the illustrated embodiment, when both the magnetic toner $T_1$ and non magnetic toner $T_2$ are used in the same apparatus, even if the same fixing device is used, since the fixing operations are performed respectively after the temperature adjustment sequence is altered to conform the toner to be used, the offset of any toner can be avoided, thus effecting an adequate fixing operation.

Incidentally, in the illustrated embodiment, the magnetic toner $T_1$ and the non-magnetic toner $T_2$ were used, when the toner having the lower offset temperature is used, the over-chute can be prevented by setting the stand-by temperature to have the same value as the fixing temperature.

Further, in the illustrated embodiment, the exchange of the developing containers was effected by replacing only the developing container by a new one, when the developing container is formed as a process cartridge together with at least a photosensitive member as disclosed in the U.S. Pat. No. 4,598,993, the exchange of the developing containers may be effected by replacing the process cartridge by a new one.

Figure 5:
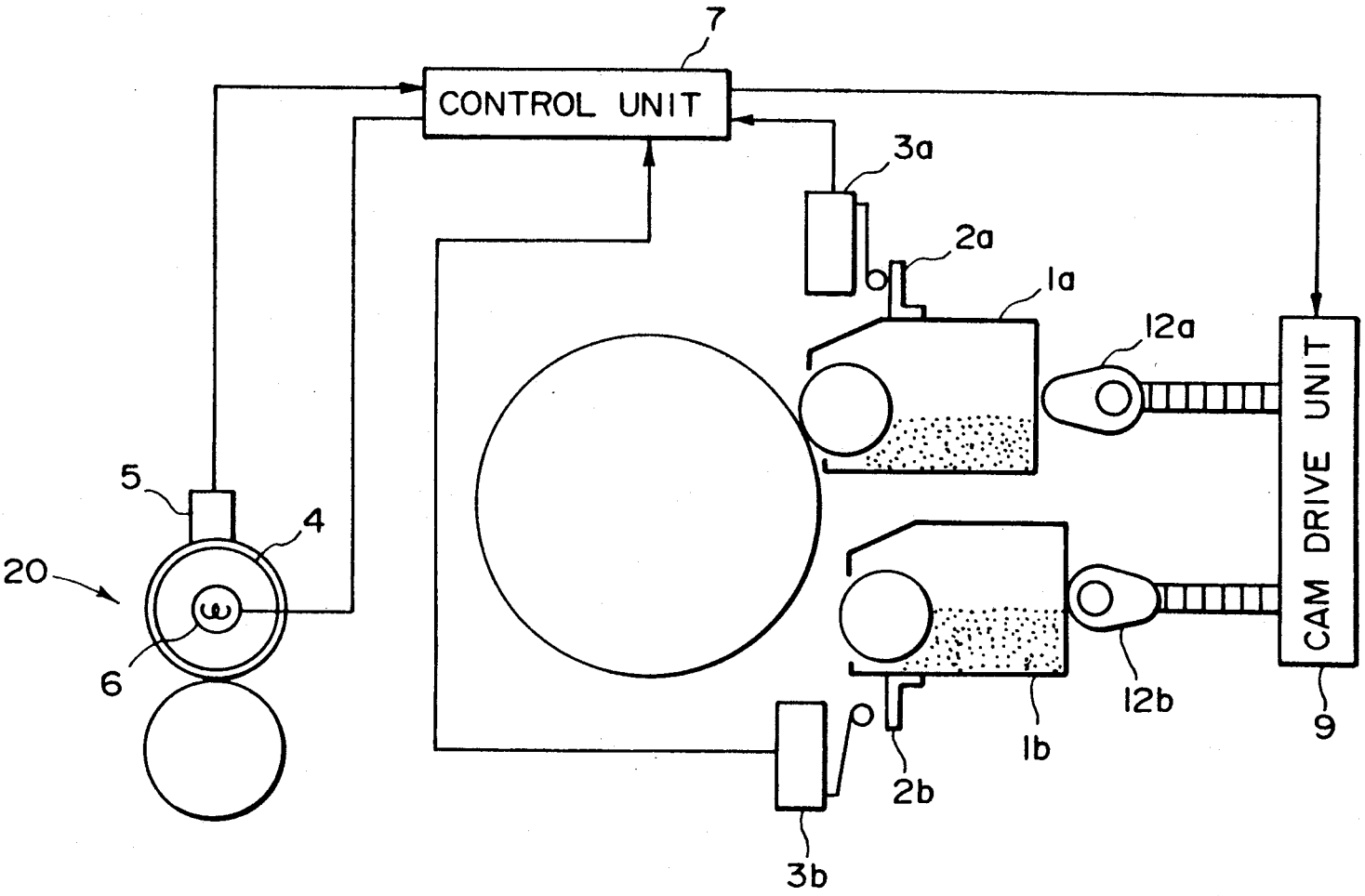
FIG. 5 is a schematic constructual view showing an image forming apparatus according to another embodiment of the present invention.
Figure 6A:
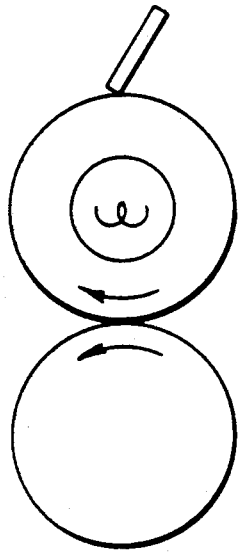
FIG. 6A PRIOR ART
FIGS. 6A to 6C shows examples of the fixing device of the image forming apparatus.
Figure 6B:
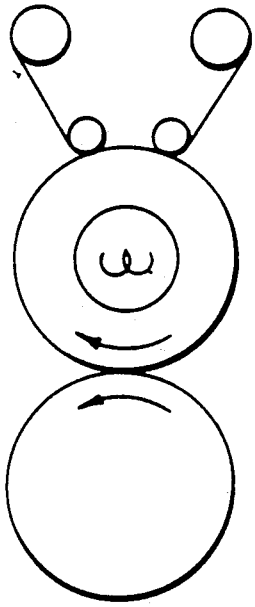
FIG. 6B PRIOR ART
Figure 6C:
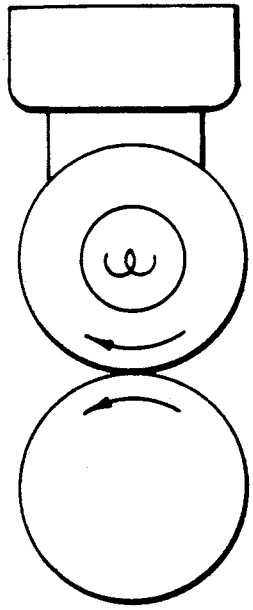
FIG. 6C PRIOR ART
Figure 5:
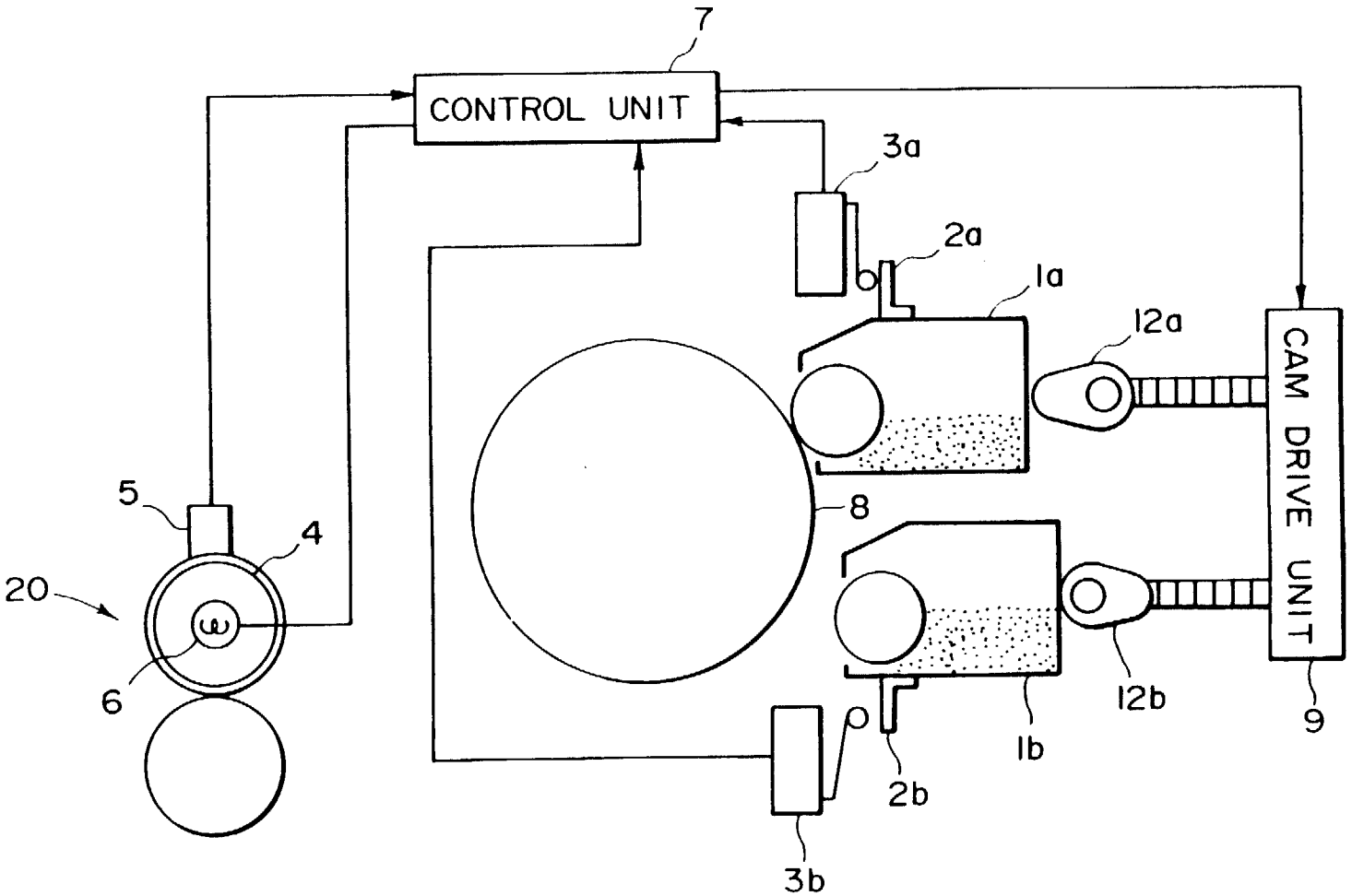

FIG. 5 shows an image forming apparatus according to a second embodiment of the present invention.

In contrast with the iamge forming apparatus of the above-mentioned first embodiment having the removable developing container 1, as shown, the image forming apparatus according to the second embodiment includes two developing containers 1*a* and 1*b* accommodating different kinds of toners, which can be selectively used in the fixing process at need.

In FIG. 5, the reference numeral 9 designates a cam drive unit for changing over the above developing container 1*a* or 1*b* to a developing position or a non-developing position. In the illustrated embodiment, the cam drive unit 9 comprises eccentric cams 12*a* and 12*b* for contacting or separating the respective developing containers 1*a* and 1*b* with respect to the photosensitive drum 8. The cam drive unit 9 is connected to the control unit 7 so that either of the eccentric cams is driven on the basis of the drive signal sent from the control unit.

In operation, when it is assumed that a command signal indicative the use of the toner $T_1$ accommodated in the developing container 1*a* is sent to the control unit 7 by manipulating an operation panel (not shown) for selecting the toner $T_1$, the control unit 7 sends the drive signal for activating the developing container 1*a* to the cam drive unit 9. Subsequently, the cam drive unit 9 drives the eccentric cam 12*a* in response to the drive signal, thereby shifting the developing container 1*a* to a predetermined position with respect to the photosensitive drum 8. Consequently, the lever 2*a* fixed to the developing container 1*a* pushes the corresponding switch 3*a*, with the result that the same control operation as in the case of the first embodiment is effected to perform the temperature adjustment sequence suited for the selected toner $T_1$ accommodated in the developing container 1*a*. Similarly, a lever 2*b* fixed to the developing container 1*b* pushes corresponding switch 3*b*.

Incidentally, in this second embodiment, while an example that two developing containers are used in the image forming apparatus was explained, three or more developing containers may be arranged in the image forming apparatus at need.

According to the present invention, in the image forming apparatus using two or more kinds of toners to form the image, since the set temperature of the thermal fixing means in the stand-by condition can be controlled in accordance with the kind of toner to be used, the so-called offset of toner generated by the thermal fixing means in the fixing process can be effectively prevented, thus providing the adequate fixing operation.

As mentioned, while the present invention was explained with reference to specific embodiments thereof, it should be noted that the present invention is not limited to such embodiments, but can be modified and altered without the departure of the scope and spirit of the present invention.

What is claimed is:

1. An image forming apparatus which can develop a latent image formed on a latent image bearing member with a selected one of a first toner and a second toner different from the first toner, said image forming apparatus comprising:

fixing means for fixing a toner image, said fixing means including a heat member heated by a heat source and contacted with the toner image; and means for adjusting a temperature difference between a stand-by temperature and a fixing temperature in accordance with the selected toner, wherein the stand-by temperature of the first toner and the stand-by temperature of the second toner are different from each other.

2. An image forming apparatus according to claim 1, wherein said adjusting means includes:

temperature detecting element for detecting a temperature of a contact surface between said heat member and the toner image; and control means for controlling said heat source so that a detection output from said temperature detecting element has a predetermined set value, wherein the temperature of said heat member in a stand-by condition is altered by altering the set value.

3. An image forming apparatus according to claim 1, wherein said heat source comprises a heated rotary member heated by said heat source, and wherein said fixing means further includes a back-up rotary member pressed against said heated rotary member, whereby the toner image is fixed by passing a bearing medium bearing the toner image through between said heated rotary member and said backup rotary member.

4. An image forming apparatus according to claim 1, wherein said adjusting means includes a discriminating means for discriminating a kind of toner, and wherein a temperature of said heat member in a stand-by condition is altered in response to a discriminating signal from said discriminating means.

5. An image forming apparatus according to claim 4, further comprising a first developing container for accommodating the first toner and a second developing container accommodating the second toner, said first and second developing containers being adapted for positioning in either a developing position or a non-developing position, wherein said discriminating means discriminates the kind of toner in accordance with the position of said first and second developing containers.

6. An image forming apparatus according to claim 4, wherein a first developing container accommodating the first toner is replaceable by a second developing container accommodating the second toner, and wherein said discriminating means discriminates the kind of toner by the insertion of one of the developing container into the image forming apparatus.

7. An image forming apparatus according to claim 1, wherein the first toner comprises a magnetic toner including a magnetic component and the second toner comprising a non-magnetic toner not including magnetic component, and wherein a stand-by temperature of said second toner is selected higher than that of the first toner.

8. An image forming apparatus which can develop a latent image formed on a latent image bearing member with a selected one of a first toner and a second toner different from the first toner, said image forming apparatus comprising:

fixing means for fixing a toner image, said fixing means including a heat member heated by a heat source and contacted with the toner image; and means for adjusting a temperature difference between a stand-by temperature and a fixing temperature in accordance with the selected toner, the fixing temperature of the first toner and the fixing temperature of the second toner are different from each other.

* * * * *

UNITED STATES PATENT AND TRADEMARK OFFICE

CERTIFICATE OF CORRECTION

PATENT NO. : 5,073,799

DATED : December 17, 1991

INVENTOR(S) : Tsuyoshi Watanabe

It is certified that error appears in the above-identified patent and that said Letters Patent is hereby corrected as shown below:

The title page, showing the illustrative figure, should be deleted and substitute therefor the attached title page.

IN THE DRAWINGS, SHEET 3 of 4

Fig. 5 should be deleted and substitute therefor the attached page, show-
Fig. 5, in which reference number 8 and lead line have been inserted.

United States Patent [19]

Watanabe

[11] Patent Number: 5,073,799

[45] Date of Patent: Dec. 17, 1991

[54] IMAGE FORMING APPARATUS WHICH ALTERS STAND-BY TEMPERATURE OF THE FIXING DEVICE ACCORDING TO TONER COLOR

[75] Inventor: Tsuyoshi Watanabe, Kawasaki, Japan

[73] Assignee: Canon Kabushiki Kaisha, Tokyo, Japan

[21] Appl. No.: 401,108

[22] Filed: Aug. 31, 1989

[30] Foreign Application Priority Data

Sep. 2, 1988 [JP] Japan ..... 63-218276

[51] Int. Cl.[5] ..... G03G 15/20

[52] U.S. Cl. ..... 355/285; 355/208; 219/216

[58] Field of Search ..... 355/295, 290, 285, 282, 355/208, 245, 326, 327, 206, 311; 219/216, 469; 432/60, 228

[56] References Cited

U.S. PATENT DOCUMENTS

| | | | |
|---|---|---|---|
| 4,097,139 | 6/1978 | Hauser et al. | 355/326 |
| 4,144,835 | 3/1979 | Fukase et al. | 219/216 X |
| 4,385,826 | 5/1983 | Itoh | 355/295 |
| 4,480,908 | 11/1984 | Anzai et al. | 355/285 |
| 4,696,880 | 9/1987 | Shoji et al. | 430/42 |

FOREIGN PATENT DOCUMENTS

| | | | |
|---|---|---|---|
| 0070571 | 4/1986 | Japan | 355/208 |
| 61-103178 | 5/1986 | Japan . | |
| 0126585 | 6/1986 | Japan | 355/208 |
| 0204651 | 9/1986 | Japan | 355/245 |
| 0200382 | 9/1987 | Japan | 355/208 |

OTHER PUBLICATIONS

European Search Report.

*Primary Examiner*—Arthur T. Grimley
*Assistant Examiner*—William J. Royer
*Attorney, Agent, or Firm*—Fitzpatrick, Cella, Harper & Scinto

[57] ABSTRACT

An image forming apparatus which can develop a latent image formed on a latent image bearing member with a selected one of a first toner and a second toner different from the first toner. A fixing member is provided for fixing a toner image, and includes a heat member heated by a heat source being contacted with the toner image. A controller is provided for adjusting a temperature difference between a stand-by temperature and the fixing temperature in accordance with the selected toner.

8 Claims, 4 Drawing Sheets

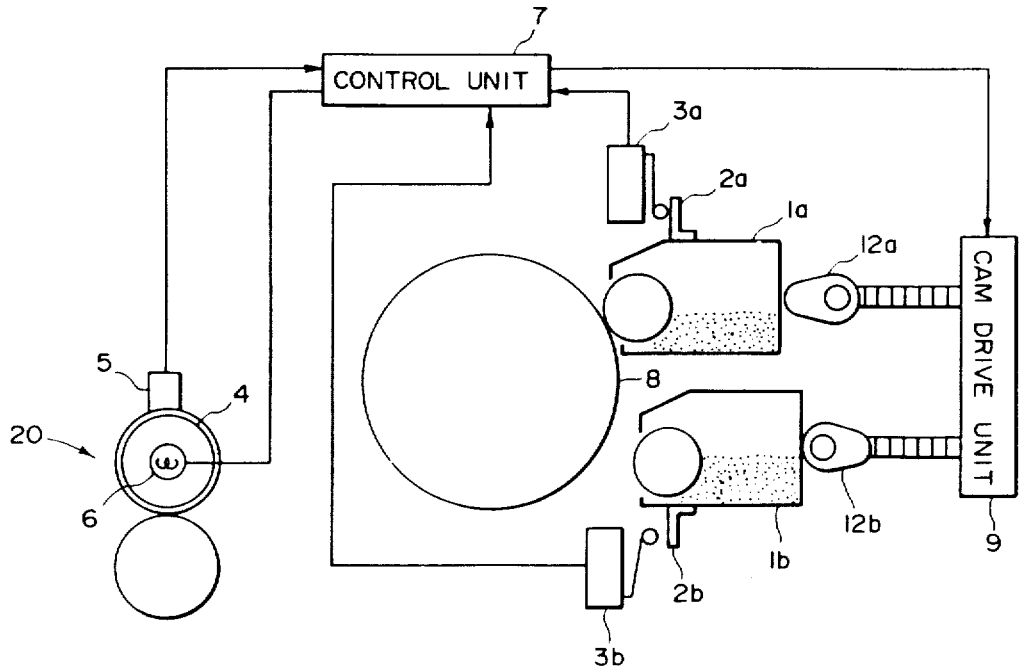

UNITED STATES PATENT AND TRADEMARK OFFICE

CERTIFICATE OF CORRECTION

PATENT NO. : 5,073,799

DATED : December 17, 1991

INVENTOR(S) : Tsuyoshi Watanabe

It is certified that error appears in the above-identified patent and that said Letters Patent is hereby corrected as shown below:

COLUMN 2

Line 49, "sensitive" should be deleted.

COLUMN 3

Line 9, "comprises" should read --comprising--.
Line 11, "pressed" should read --presses--.
Line 21, "among from" should read --from among--.
Line 35, "the change" should read --a change--.
Line 53, "apparatus" should read --apparatus,--.

COLUMN 4

Line 37, "increases" should read --increases to--.
Line 52, "over-chute" should read --overshoot--.
Line 58, "non magnetic" should read --non-magnetic--.
Line 68, "over-chute" should read --overshoot--.

COLUMN 5

Line 5, "one, when" should read --one. When--.
Line 1 , "iamge" should read --image--.
Line 63, "departure of" should read --departure from--.

UNITED STATES PATENT AND TRADEMARK OFFICE

CERTIFICATE OF CORRECTION

PATENT NO. : 5,073,799

DATED : December 17, 1991

INVENTOR(S) : TSUYOSHI WATANABE

It is certified that error appears in the above-identified patent and that said Letters Patent is hereby corrected as shown below:

COLUMN 6

Line 36, "container" should read --container for--.
Line 47, "container" should read --containers--.
Line 51, "comprising" should read --comprises--.
Line 66, "are" should read --being--.

Signed and Sealed this

Sixth Day of July, 1993

Attest:

Michael K. Kirk

MICHAEL K. KIRK

Attesting Officer

Acting Commissioner of Patents and Trademarks